United States Patent [19]

Kuhn

[11] 4,306,694

[45] Dec. 22, 1981

[54] DUAL SIGNAL FREQUENCY MOTION MONITOR AND BROKEN RAIL DETECTOR

[75] Inventor: John J. Kuhn, Allison Park, Pa.

[73] Assignee: American Standard Inc., Swissvale, Pa.

[21] Appl. No.: 162,470

[22] Filed: Jun. 24, 1980

[51] Int. Cl.[3] ..... B61L 1/20; B61L 29/32

[52] U.S. Cl. ..... 246/125; 246/34 R; 246/34 CT; 246/34 A; 246/28 C; 246/121

[58] Field of Search ..... 246/122 R, 125, 128, 246/34 R, 34 A, 34 C, 34 CT, 130, 28 C, 120, 121; 324/217

[56] References Cited

U.S. PATENT DOCUMENTS

| | | | |
|---|---|---|---|
| 3,610,920 | 10/1971 | Frielinghaus | 246/128 |
| 3,614,418 | 10/1971 | Peel | 246/128 |
| 3,696,243 | 10/1972 | Risely | 246/121 |
| 3,777,139 | 12/1973 | Peel | 246/125 |
| 3,944,173 | 3/1976 | Moe et al. | 246/34 CT |
| 3,974,991 | 8/1976 | Geiger | 246/34 CT |
| 3,977,634 | 8/1976 | Smith | 246/128 |
| 3,987,989 | 10/1976 | Geiger | 246/34 R |

*Primary Examiner*—James J. Groody
*Attorney, Agent, or Firm*—J. B. Sotak

[57] ABSTRACT

A highway crossing warning system for monitoring the motion and predicting the time of arrival of an approaching train at the highway crossing and for detecting the presence of a broken rail in the approach zone by feeding dual frequency signals into the track rails and measuring the track impedances at the two frequencies and the phase angle of the lower of the two frequencies.

5 Claims, 5 Drawing Figures

DUAL SIGNAL FREQUENCY MOTION MONITOR AND BROKEN RAIL DETECTOR

FIELD OF THE INVENTION

This invention relates to a dual signal frequency motion monitor and broken rail detector and more particularly to a railway highway crossing warning system for sensing an approaching train and for detecting a broken rail to cause the initiation of a warning device.

BACKGROUND OF THE INVENTION

In former railway grade crossing protection arrangements, it was conventional practice to detect motion of oncoming trains by continuously monitoring the track impedance and by sensing a change in the impedance. It will be appreciated that the reliability of the motion sensing and the accuracy of the time of arrival prediction are dependent upon a linear relationship between the track impedance and the distance to a train. That is, under certain conditions, the distance that a train is from the highway crossing is directly proportional to the impedance across the track rails. However, when a broken rail exists in the approach zone, the impedance at the crossing is proportional to the distance to a train only as far as the break. Thus, a train cannot be detected beyond the point of the broken rail. It has been found that when a partial break of several ohms resistance occurs, the presence of a train just beyond the point of fracture appears to be several thousand feet further away. Thus, the result of a partial as well as total break in the approach tracks can significantly reduce the amount of warning time given to motorists and pedestrians at the highway crossing. In order to avoid such a potentially dangerous situation, it is mandatory to detect any broken rail in the approach zones so that appropriate action can be taken to protect the lives and property of individuals. Presently, railroad crossing warning systems employ one of two techniques for detecting broken rails, namely, either a wrap-around circuit or a high level detector. The wrap-around circuit employs an audio frequency overlay (AFO) track circuit which extends along the entire length of the approach zones. In practice, the AFO wrap-around circuit functions to provide an initial train entrance into the approach zone and thereafter transfers the control of the highway crossing warning apparatus to the motion detector. That is, only after the presence of a train is recognized by the AFO circuit is the motion detector activated to measure the distance to the approaching train. Thus, the use of the AFO wrap-around track circuit insures the crossing warning time will not be shortened or reduced due to the occurrence of a broken rail in the approach zones. However, the additional hardware required to implement AFO train detection results in a significant increase in the overall cost of the highway crossing protection system. The high level detector arrangement employs a threshold detecting circuit incorporated with the motion sensing apparatus. In case a high resistance break in a rail occurs near the crossing area, the track impedance increases beyond the normal operating limits of the apparatus. Thus, the high impedance level is detected and the crossing warning devices are activated under such a broken rail condition. However, while the threshold detector provides some minimum amount of warning time, in some instances, there may be a significant reduction in the crossing warning time. Accordingly, such a proposal is not entirely satisfactory since the hazard of a broken rail is not completely eliminated.

OBJECTS OF THE INVENTION

Accordingly, it is an object of this invention to provide a new and improved railway highway crossing protection system.

A further object of this invention is to provide a unique railroad crossing warning system including motion monitoring and broken rail detection.

Another object of this invention is to provide a novel dual frequency motion sensor and broken rail detector.

Still a further object of this invention is to provide an improved railroad crossing warning system having a motion monitor and broken rail detection for activating an alarm when an approaching train is within a given time from the crossing or when a broken rail exists in the approach zone.

Still another object of this invention is to provide a superior motion sensor and broken rail indicator for a railroad highway warning system.

Yet a further object of the invention is to provide a railway crossing warning system for monitoring the motion of vehicles approaching a highway crossing and for detecting a broken rail in an approach zone comprising, means for sensing high and low frequency voltage signals, means for sensing high and low frequency current signals, means for filtering and separating the high and low frequency voltage signals into a discrete high frequency voltage signal and a discrete low frequency voltage signal, means for filtering and separating the high and low frequency current signals into a discrete high frequency current signal and a discrete low frequency current signal, means for calculating the actual high frequency impedance of the discrete high frequency current and voltage signals, means for calculating the actual low frequency impedance of the discrete low frequency current and voltage signals, means for detecting the phase angle of the discrete low frequency current and voltage signals, means for detecting motion by initially storing and subsequentially updating the actual low frequency impedance and phase angle to determine an approaching vehicle, means for calculating rail integrity of the track by multiplying the actual low frequency impedance with a function of the phase angle to obtain an estimated high frequency impedance, means for comparing the estimated high frequency impedance with the actual high frequency impedance to determine the integrity of the rails of the track and means responsive to the motion detecting means and the rail integrity comparing means for providing a warning of an approaching vehicle or an existing broken rail.

SUMMARY OF THE INVENTION

In accordance with the present invention, there is provided a railroad highway crossing protection system for monitoring the motion of an approaching train and for detecting a broken rail in an approach zone. A pair of conductors is directly connected to the track rails for injecting high and low frequency constant voltage signals into the trackway. An impedance bond is connected across the track rail at a remote point which establishes the outer limit of an approach zone. A pickup coil is disposed alongside one of the track rails at a given distance from the highway crossing to establish a positive protection island zone. The pickup coil senses high and low frequency current signals flowing in the track rails. The high and low voltage signals in the track rails are conveyed to a first pair of high and low frequency filters which separate the voltage signals into a discrete high frequency voltage signal and a discrete low frequency voltage signal. The current signals induced into the pickup coil are conveyed to a second pair of high and low frequency filters which separate the current signals into a discrete high frequency current signal and a discrete low frequency current signal. The discrete low frequency voltage and current signals are fed to an impedance calculator which produces an output signal proportional to the actual low frequency impedance. The discrete low frequency voltage and current signals are also fed to a phase detector which produces an output signal proportional to the low frequency phase angle. The discrete high frequency voltage and current signals are fed to an impedance calculator which produces an output signal proportional to the actual high frequency impedance. The discrete high frequency current signal is also fed to a threshold level detector which produces an output signal when the absolute value of the track current exceeds a predetermined amount. The low frequency impedance and phase angle signals are fed to a motion detector which samples, stores and updates the impedance and phase angle signals to determine whether or not an approaching train is in the approach zone. The low frequency impedance and phase angle impedance are also fed to a rail integrity calculator which produces an estimated high frequency impedance signal by multiplying the actual low frequency impedance output signal with a function of the low frequency phase angle output signal. The estimated and actual high frequency impedance signals are fed to a rail integrity comparator which compares the value of the estimated high frequency impedance signal to the value of the actual high impedance signal to determine whether or not a broken rail exists in the approach zone. A three-input AND gate coupled to the outputs of the motion detector, rail integrity comparator and level detector which normally keeps a vital relay energized to maintain the highway crossing warning devices deactivated unless an approaching train is a given distance and velocity from the highway crossing, a broken rail exists in the approach zone and/or the output signal of the level detector disappears.

DESCRIPTION OF THE DRAWINGS

The foregoing objects and other attendant features and advantages of the subject invention will become more fully apparent from the following detailed description when read in conjunction with the accompanying drawings wherein:

Referring now to FIG. 1 of the drawings, there is shown a grade crossing protection system for alerting the highway users of oncoming trains.

Figure 1:
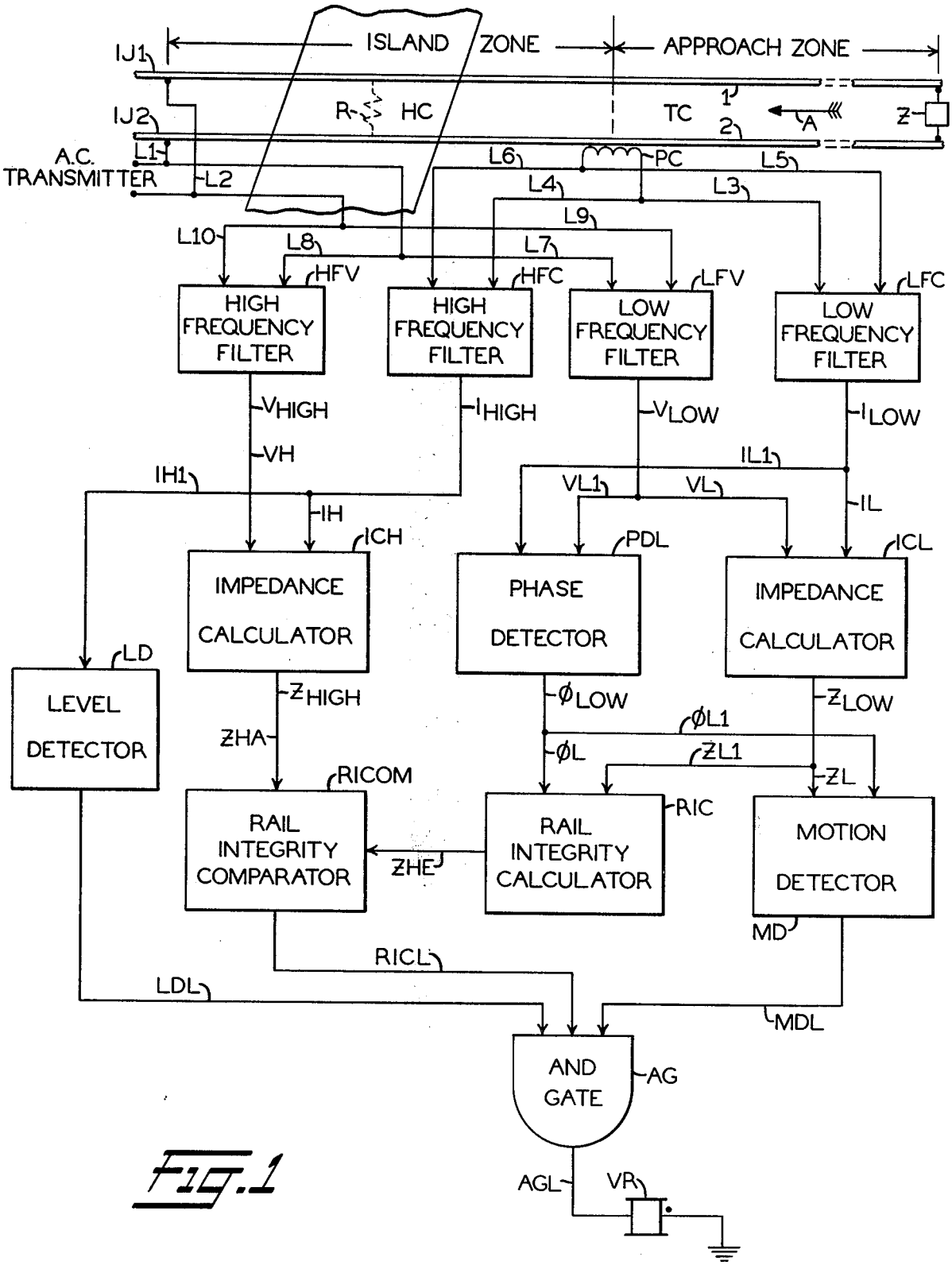
FIG. 1 of the drawings illustrates a schematic circuit block diagram of a railway crossing warning system including motion monitoring and broken rail detecting apparatus.

As shown, a highway or roadway HC is intersected or crossed by a track or trackway which includes a pair of running rails 1 and 2. It has been found that in order to provide the highest degree of safety and protection to pedestrians and motorists, it is advisable to design the end of the approach zones as long as possible from the highway crossing and to provide an island zone around the highway crossing to establish a positive protection area. In practice, it is highly desirable to provide a constant warning time in activating the cautionary signals, such as, sounding the bell, flashing the lights, and/or lowering the barrier gates, when a train or transit vehicle enters the approach zones. It will be appreciated that the speeds of trains entering the approach zone may range from a maximum to a minimum value so that the time of arrival at the highway crossing may vary over a wide interval. Thus, in order to effectively alert motorists and pedestrians of the ensuing peril, it is necessary to detect the presence and to discern the speed of an oncoming train in the approach zone to accurately predict its time of arrival at the highway crossing. As mentioned above, it is common practice to provide a positive protection area or section at the highway crossing HC so that when a train or transit vehicle is within the island zone, the warning apparatus is constantly activated until such time as the last vehicle exits the island zone and its rear wheels clear the insulated joints IJ1 and IJ2.

For the purpose of convenience, it will be presently assumed that the trains or transit vehicles travel in the direction as shown by arrow A so that they enter the approach zone at the right in viewing the drawing. As shown, a.c. signals are connected to the track circuit TC via a pair of conductive leads L1 and L2 which are coupled to a suitable a.c. transmitter. In practice, the a.c. transmitter consists of two oscillators, an amplifier and a dual frequency filter. One of the two oscillators generates a high frequency audio signal while the other of the two oscillators generates a low frequency audio signal. The oscillators are solid-state crystal controlled circuits to assure a precise frequency of oscillations. The frequency of the low frequency signal is in the range of 150 Hz to 600 Hz while the frequency of the high frequency signals may be in the range of 600 Hz to 2,000 Hz. The high and low frequency signals are combined and are amplified to an amplitude sufficient to operate the system with some arbitrary noise and interference immunity. The amplified signals are fed to the dual frequency filter circuit which reduces the harmonics and provides isolation from any coded signals in the track. The dual frequency voltage signals are conveyed to the track rails 1 and 2 and are also fed to a pair of band-pass filters which will be described hereinafter. The lumped ballast leakage resistance is illustrated by a phantom resistive or impedance element R which occurs at the crossing area due to the accumulation or buildup of snow, mud, salt, cinders and other foreign substance which takes place during the winter season. A shunt impedance Z is connected between the track rails 1 and 2 at a distance location from the highway crossing HC to establish an approach zone. A pickup coil PC is disposed a given distance from the highway crossing HC and is situated adjacent track rail 2. It will be noted that the island zone is defined as the distance between transmitted rail connections and the position of the pickup coil. Further, the approach zone is determined by the position of the a.c. shunt impedance Z which is welded between the rails 1 and 2. The shunt impedance Z is preferably a narrow band, sharply tuned, resonant circuit which is hard-wired connected to the rails 1 and 2 when used in coded signal territory. However, it is understood that in nonsignal territory, the shunt Z may be a suitable wide band a.c. element, such as, a capacitor or a length of wire.

It will be noted that the pickup coil PC senses the amount of high and low frequency current which is actually flowing through the track rails 1 and 2. The signals induced in pickup coil PC are fed to suitable high and low frequency filters HFC and LFC, respectively. As shown, one end of pickup coil PC is connected to the input of low band-pass filter LFC by lead L3 and is connected to the input of low band-pass filter LFC by lead L5 and is connected to the input of high band-pass filter HFC by leads L6 and L4. It will be seen that the voltage developed across the track rails 1 and 2 is also sensed and is fed to suitable high and low frequency filters HFV and LFV, respectively. As shown, one input of the low frequency band-pass filter LFV is connected by lead L7 to the track lead L1 while one input of the high frequency band-pass filter HFV is connected by lead L8 to the track lead L1. The other input of the low frequency band-pass filter LFV is connected by lead L9 to the track lead L2 while the other input of the high frequency band-pass filter is connected by lead L10 to the track lead L2.

It will be noted that the low frequency current signals passed by filter circuit LFC are fed to the current input of an appropriate impedance calculator ICL via lead IL and to the current input of a suitable phase detector PDL. As shown, the low frequency voltage signals passed by filter circuit LFV are fed to the voltage input of the impedance calculator ICL via lead VL and to the voltage input of phase detector PDL. The output of the impedance calculator takes the form of a d.c. voltage which is proportional to low frequency voltage divided by the low frequency current, namely, $$Z_{LOW}=E_{LOW}/I_{LOW}.$$

The output of the phase detector represents the relative phase shift between the low frequency track voltage and rail current, namely, the phase angle $\phi_{LOW}$.

It will be observed that the high frequency current signals passed by the filter circuit HFC are fed to the current input of an appropriate impedance calculator ICH via lead IH and are also fed to the input of a suitable level detector LD via lead IH1. As shown, the high frequency voltage signals passed by the filter circuit HFV are fed to the voltage input of the impedance calculator ICH via lead VH. Like impedance calculator produces a d.c. output voltage which is proportional to the high frequency voltage divided by the high frequency current, namely, $$Z_{HIGH}=E_{HIGH}/I_{HIGH}.$$

The d.c. voltage $Z_{LOW}$ developed by the impedance calculator ICL is fed to the low impedance input of a motion detector MD via lead Z1 and is also fed to the low impedance input of a rail integrity calculator RIC via lead ZL1. The output $\phi_{LOW}$ of phase detector PDL is fed to the phase angle input of the rail integrity calculator RIC via lead $\phi$L and is also fed to the phase angle input of the motion detector MD via lead $\phi$L1. The motion detection is achieved by measuring the linearized track impedance and sensing any change in this impedance as an indication of train movement. As shown, the output of the motion detector MD is connected by lead MDL to one input of a three-input AND gate AG. The rail integrity calculator RIC predicts and calculates the rail integrity by multiplying the low frequency impedance input on lead ZL1 by a function of the low frequency phase angle on lead $\phi$L to obtain an estimated high frequency impedance value. The actual measured high frequency impedance is conveyed by lead ZHA to a rail integrity comparator RICOM, and the estimated calculated high frequency impedance is conveyed by lead ZHE to the rail integrity comparator RICOM. The output of the rail integrity comparator RICOM is connected by lead RICL to a second input of the three-input AND gate AG. The third input of the AND gate AG is connected by lead LDL to the output of the level detector LD. The output of the AND gate AG is connected by lead AGL to a vital relay VR which is normally energized during the absence of a train in the approach and island zones to cause the electrical contacts to the power circuit for the lights, bell, and/or gate mechanism to assume an open position so that no warning signal is conveyed to the general public.

Figure 2:
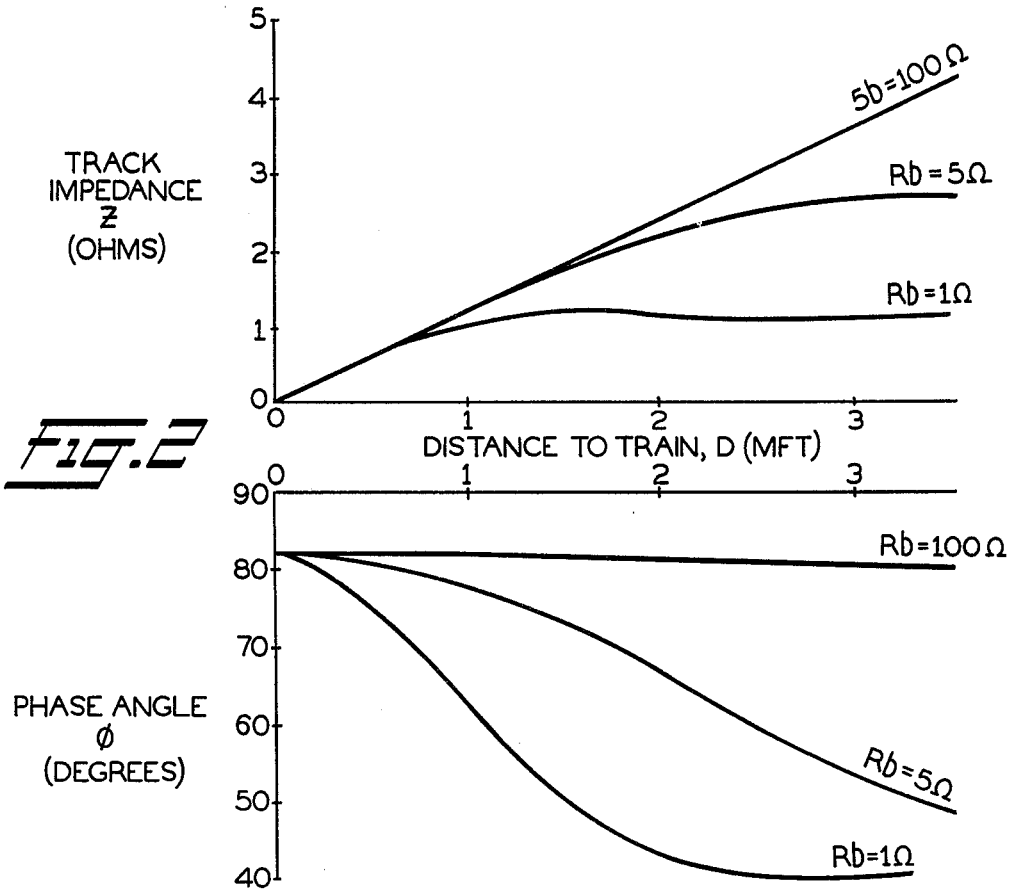
FIGS. 2, 3, 4 and 5 are graphic curves to be used in the description of the embodiment of FIG. 1 and in the understanding of the theory of operation of the present invention.
Figure 3:
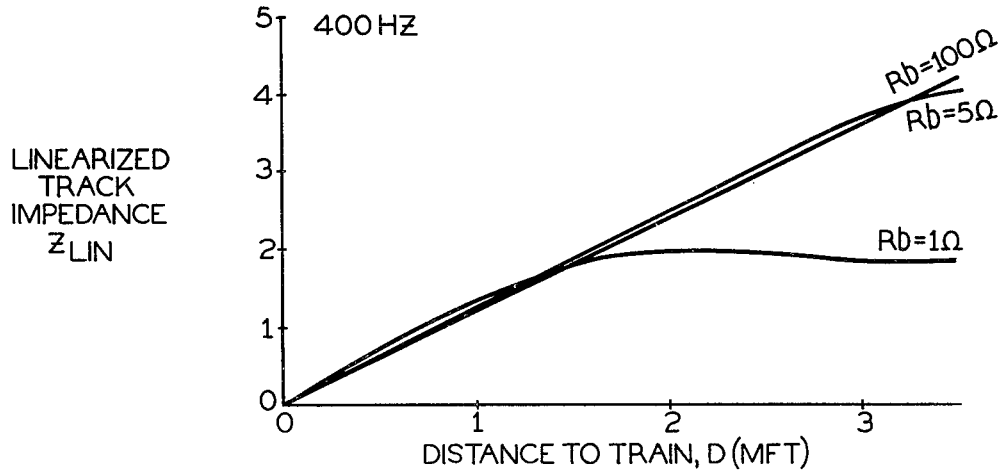

Referring now to FIG. 2, there is shown in the upper graph the track impedance (Z) versus the distance (D) to a train and in the lower graph the phase angle ($\phi$) versus the distance (D) to a train. It will be seen that the track impedance can be used to measure the distance to a train since rail impedance is directly proportional to the length of the track circuit. In viewing FIG. 2, it will be noted that under a dry ballast condition $R_b=100\ \Omega$, the track impedance is approximately equal to the rail impedance over the desired approach distance. However, under a wet ballast condition $R_b=1\ \Omega$ or $R=5\ \Omega$, the track impedance curves are not linear beyond a given point so that track impedance is no longer directly proportional to the distance to a train. In examining the curves on the upper graph of FIG. 2, it will be noted that the bottom curve $R_b=1\ \Omega$ which is representative of one ohm per thousand feet of ballast, the track impedance is significantly nonlinear beyond one thousand feet. Thus, it is impractical to base motion sensing on track impedance alone beyond the thousand-foot point. However, in viewing the curves on the lower graph of FIG. 2, it will be observed that the $R_b=1\ \Omega$ curve continues to change rapidly out to a distance of about two thousand feet. The use of the phase angle information can be utilized to improve the accuracy of the motion sensing so that the maximum feasible approach distance can be significantly increased. As shown in FIG. 3, the track impedance can be linearized by multiplying the measured impedance by a second order function derived from the phase angle. It has been found that for the curves shown in FIG. 2, the linearized function would take the form of:

$$Z_{lin}=Z(3.103-0.04423\phi+0.0002274\phi^2).$$

Thus, it can be seen that the linearized impedance for $R_b=1\ \Omega$ curve makes it possible to sense motion up to approximately 1700 feet, and that the $R_b=5\ \Omega$ linearized curve is almost a straight line up to the 3500-foot point.

However, it has been found that both the track impedance and phase angle information is still insufficient to detect a broken rail under all conditions of ballast leakage, break location and break resistance. For example, a rail break of several ohms with moderate ballast conditions can result in the same track impedance and phase angle as a track circuit at low ballast with the rail intact. Thus, the technique has been developed to detect broken rails by utilizing the track impedance at two different audio frequencies, and the phase angle of the impedance at the lower of these two frequencies. It will be appreciated that when the frequency of track voltage is increased, the impedance of track circuit increases due to the inductive characteristics exhibited by the track rails. The ratio of the impedance which is measured at the two frequencies as a function of the distance to a train can be approximated by a polynominal derived from the phase angle of the track impedance at the lower of the two operating frequencies. This may be demonstrated mathematically as a simple algebraic manipulation of the approximation equation:

$$Z_{HIGH}/Z_{LOW}=F(\phi_{LOW})$$

wherein $Z_{HIGH}$ is the impedance value at the high operating frequency, $Z_{LOW}$ is the impedance value at the low operating frequency, and $\phi_{LOW}$ is the phase angle value at the low operating frequency.

If we now multiply through by the low frequency track impedance, the following results:

$$Z_{HIGH}=Z_{LOW}\times F(\phi_{LOW}).$$

This latter equation is now used to predict the estimated high frequency impedance from the low frequency data. The estimated high frequency impedance is then compared to the measured high frequency impedance to assure the integrity of the track rails.

Figure 4:
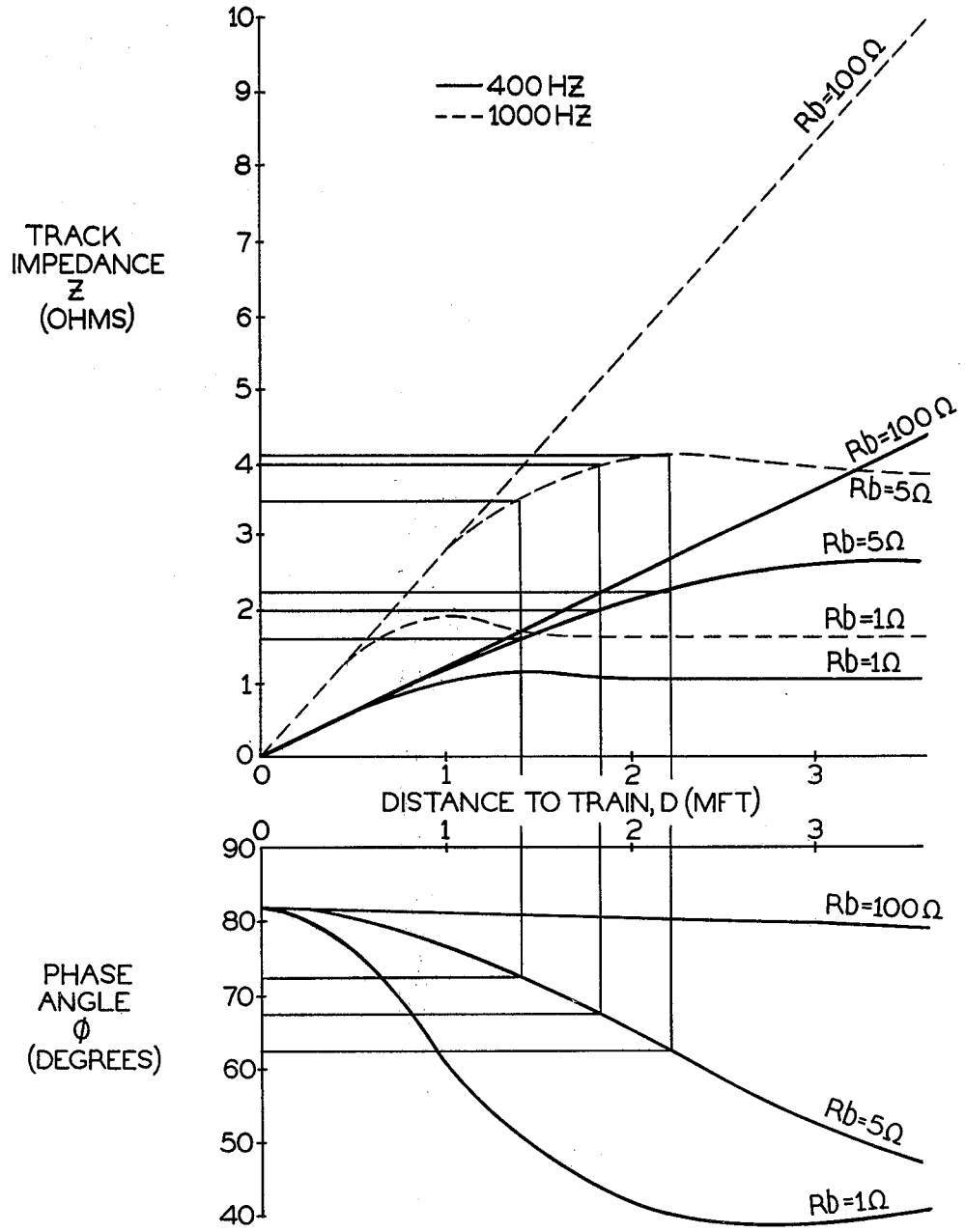

The approximated polynominal is derived by performing the following steps:

(a) Establish and examine a set of curves of the track impedance and phase angle versus the distance to a train for a number of different ballast resistance values at each of the two operating frequencies, such as, shown in FIG. 4, and (b) judiciously choose a number of data points at which the approximation will give an exact prediction of the high frequency track impedance.

It will be appreciated that for an nth order approximation of the form, $$F(\phi)=(C_0+C_1\phi+C_2\phi^2+\ldots+C_n\phi^n)$$

n+1 data points must be chosen. Thus, the n+1 data values establish n+1 simultaneous equations which that the form, $$Z_{HIGH}=Z_{LOW}(C_0+C\phi+C_2\phi^2+\ldots+C_n\phi^n)$$

which are then solved for the coefficients $C_0$, $C_1$, $C_2$, etc.

While in many cases, a sufficiently accurate approximation can be obtained with only a second order polynominal, it has been found that the response of the system to a broken rail using such a simple approximation will not guarantee detection of a rail break at all times. It will be noted that the requirements for the approximation polynominal for use in broken rail detection are that a rail break of sufficient magnitude occurring anywhere in the approach zone which causes a significant reduction in the warning time must be detectable over the entire operating range of ballast leakage. It has been found that the following fourth order polynominal, $$F(\phi)=-C_0+C_1\phi-C_2\phi^2+C_3\phi^3-C_4\phi^4$$

provides the required system response where the coefficients are positive real numbers.

Figure 5:
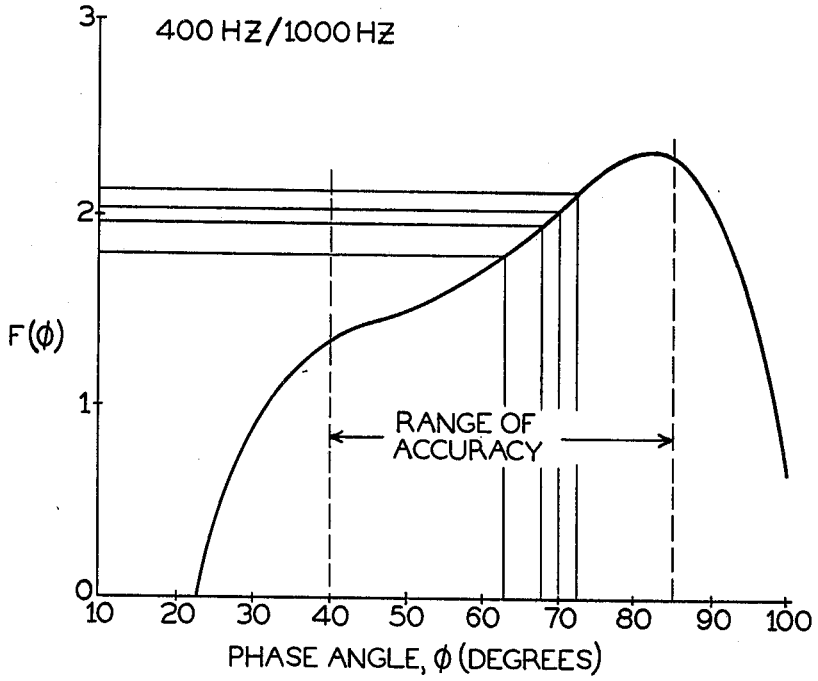

In viewing the graph of FIG. 5, it will be noted that a curve of $F(\phi)$ versus phase angle at the low frequency of 400 Hz and high frequency of 1000 Hz is derived from the curves of FIG. 4. In practice, the fourth order approximation is:

$$F(\phi)=-9.506+7846\phi-02119\phi^2+2.526\times10^4-1.0\text{-}9\times10^{-6}\phi^4.$$

It will be seen in FIG. 4 that the impedance curves at a nominal ballast resistance of 5 ohms per 1000 feet are used and the range of the phase angle is selected to be from 60 to 75 degrees. This frequency range is divided into five degree increments of 60°–65°, 65°–70° and 70°–75° which are centered at 62.5°, 67.5° and 72.5°, respectively. In plotting the phase angles of 72.5°, 67.5° and 62.5°, it will be seen that distances to a train are 1400 feet, 1850 feet and 2200 feet, respectively. At an audio frequency of 400 Hz, these distances result in track impedances of 1.63 Ω, 2.00 Ω and 2.24 Ω while at an audio frequency of 1000 Hz, these distances result in track impedances of 3.52 Ω, 4.00 Ω and 4.13 Ω. In using the equation, $$F(\phi)=Z_{HIGH}/Z_{LOW}$$

the values of $F(\phi)$ are 1.84, 2.00 and 2.16 at the phase angles of 62.5°, 67.5° and 72.5°, respectively. It will be seen that the approximated values of $F(\phi)$ taken from the curve of FIG. 5 are 1.82, 1.98 and 2.14 for phase angles 62.5°, 67.5° and 72.5°, respectively. Thus, it will be seen that the fourth order polynominal is sufficiently accurate to effectively detect a broken rail.

Turning now to FIG. 1, let us assume that no broken rail exists and that a train has entered the remote end of the approach zone. As the train approaches the highway crossing HC, the distance to the train and its velocity and acceleration are utilized to provide a constant warning time. The low frequency impedance and phase angle information are employed to generate the linearized track impedance curves, as shown in FIG. 3. As the train is approaching, the distance and impedance data are sampled and stored in the motion detector MD. The data is then repeatedly updated at a given time interval to determine the predicted time of arrival from the distance velocity and acceleration. The predicted time of arrival is then compared to the desired advance warning time. When the predicted time is less than the desired time, the motion detector removes the output signal from lead MDL so that the AND gate AG is turned off. The turning off of gate AG causes the deenergization of vital relay VR which results in the activation of the highway crossing warning devices to alert motorists and pedestrians that a train is approaching the highway crossing HC. Now when the leading wheels of the train enter the positive protection area, namely, the island zone, the voltage track signals from the transmitter are shunted so that no current signals are induced into pickup coil PC. Thus, two inputs to the AND gate AG are removed so that warning devices will continue to be energized so long as the train occupies the island zone. Now when the last wheels of the receding train pass over the insulated joints IJ1 and IJ2 and no other train is within the confines of the detection area, the warning devices are deactivated to allow the free passage of the general public. Thus, the system reverts to normal operation to monitor train movement and to check rail integrity.

As previously mentioned, broken rail detection is achieved by calculating an estimated high frequency impedance from low frequency data and, in turn, comparing the estimated high frequency impedance with the measured high frequency impedance. Thus, if the difference between estimated and measured impedance values exceeds a certain amount, which may be, for example, 25 percent, the output signal of the comparator RICOM is removed. The AND gate AG is triggered to its off condition since no input signal is present on lead RICL, and thus deenergizes relay VR which causes the actuation of the warning devices. It will be appreciated that the dual frequency technique has several other advantages besides broken rail detection. For example, any discontinuity in the approach track circuit is recognized by the broken rail detection system. As a result of this, any load on the track which presents a substantially different impedance at one of the two operating frequencies from the impedance at the other frequency is detected as if it was a broken rail. This characteristic may be used to advantage when filters are required in the track circuit systems to reduce or eliminate interference to the motion sensors produced by coded track circuits. The use of a single inductor filter is relatively safe; however, an inductor, which is large enough to eliminate noise or interference, has a detrimental effect on the operation of the coded track signaling circuit. While the use of a single L-C parallel tuned circuit permits interference-free operation of the coded track circuit and motion monitor, it will be appreciated that if the filter capacitor becomes shorted, there is a possibility that such a failure may not be detected and the safety of the motion detection system may be jeopardized. The use of two operating frequencies allows the utilization of a double L-C parallel tuned filter. In this case, a failure of any of the filter components results in the activation of the crossing warning apparatus since the motion sensor detects the failure as if it was a broken rail. In this way, the presently disclosed system is afforded additional security.

Another advantage of using a dual frequency broken rail detection system is that not only the integrity of the approach track circuit is assured but also the safe operation of the internal circuitry of the motion sensor is guaranteed. It will be seen that any single internal failure of the system up to the point where the estimated and measured impedance comparison is made will result in a sufficient impedance differential which will be detected by the comparator RICOM. Thus, the design of the subject highway crossing protection system has been directed at economy and reliability wherein nonvital circuits are combined in such a way that vital operation is achieved.

It will be appreciated that various changes, modifications and alterations may be made by persons skilled in the art without departing from the spirit and scope of the present invention. For example, the system may be used at a crossing which has bidirectional train movement. In such a situation, the insulated joints are removed and a second pickup coil is suitably located adjacent the track at a safe distance on the left side of the highway crossing HC as viewed in FIG. 1. The additional pickup coil is connected to separate high and low frequency filtering circuits which, in turn, are connected to the low frequency current inputs of a supplementary phase detector and impedance collector. The low frequency voltage inputs of the added phase detector and impedance calculator are connected to the track circuit via the low frequency voltage filter LFV. An additional high impedance calculator has its high frequency voltage input connected to the track circuit via filter HFV and has its high frequency current input coupled to the added pickup coil via the supplementary high frequency filter. A level detector which is similar to detector LD measures the absolute value of the current flowing in the left side of the track circuit. The use of the two pickup coils permits the separate measurement of the track circuit parameters associated with each approach zone independently. It will be appreciated that an additional impedance bond is connected across the track rails at a remote location to define the outer limit of the left approach zone while the island zone is defined as the distance between the two pickup coils. It will be appreciated that with the advent of microprocessors, the function of the calculator, detector comparator and gating circuits, may be accomplished in a suitably programmed digital microcomputer. In addition, it is understood that the "window" of comparator RICOM between the estimated and measured high frequency impedance may vary over a wide range, such as, 0 to 50 percent, dependent upon the circumstances. Further, it will be apparent that various other variations and ramifications may be made to the subject invention and, therefore, it is understood that all changes, modifications and equivalents within the spirit and scope of the present invention are herein meant to be encompassed in the appended claims.

Having thus described the invention, what I claim as new and desire to secure by Letters Patent, is:

1. In a railway crossing warning system for monitoring the motion of vehicles approaching a highway crossing and for detecting a broken rail in an approach zone comprising, means for sensing high and low frequency voltage signals in the track, means for sensing high and low frequency current signals in the track, means for filtering and separating said high and low frequency voltage signals into a discrete high frequency voltage signal and a discrete low frequency voltage signal, means for filtering and separating said high and low frequency current signals into a discrete high frequency current signal and a discrete low frequency current signal, means for calculating the actual high frequency impedance of said discrete high frequency current and voltage signals, means for detecting the level of said discrete high frequency current signal, means for calculating the actual low frequency impedance of said discrete low frequency current and voltage signals, means for detecting the phase angle of said discrete low current frequency and voltage signals, means for detecting motion by initially storing and sequentially updating said actual low frequency impedance and phase angle to determine an approaching vehicle, means for calculating rail integrity of the track by multiplying said actual low frequency impedance with a function of said phase angle to obtain an estimated high frequency impedance, means for comparing said estimated high frequency impedance with said actual high frequency impedance to determine the integrity of the rails of the track, and means responsive to said motion detecting means, said rail integrity comparing means and said level detecting means for providing a warning of an approaching vehicle or of an existing broken rail.

2. The railway crossing warning system as defined in claim 1, wherein said means for sensing high and low frequency current signals is a pickup coil which is disposed adjacent the track.

3. The railway crossing warning system as defined in claim 1, wherein said means for calculating the estimated high frequency impedance follows the equation:

$$Z_{HIGH}=Z_{LOW}(-C_0+C_1\phi-C_2\phi^2+\ldots+C_n\phi^n)$$

where $Z_{HIGH}$ is the estimated high frequency impedance, $Z_{LOW}$ is the actual low frequency impedance, $\phi$ is the low frequency phase angle, and $C_0, C_1, C_2, \ldots, C_n$ are positive real number coefficients.

4. The railway crossing warning system as defined in claim 1, wherein said means responsive to said motion detecting means, said rail integrity comparing means and said level detecting means is a three-input AND gate which controls the electrical condition of a relay.

5. The railway crossing warning system as defined in claim 1, wherein said level detecting means includes a threshold device which senses the absolute value of the high frequency current signals.

* * * * *